169-46 SR

1/11/83 OR 4,367,799

United States Patent [19]

Tarpley, Jr.

[11] 4,367,799

[45] * Jan. 11, 1983

[54] APPARATUS FOR CONTINUOUS DISCHARGE OF MATERIAL AT LOCALIZED DAMAGE POINT

[75] Inventor: William B. Tarpley, Jr., West Chester, Pa.

[73] Assignee: Energy & Minerals Research Co., Exton, Pa.

[ * ] Notice: The portion of the term of this patent subsequent to Jun. 23, 1982, has been disclaimed.

[21] Appl. No.: 230,220

[22] Filed: Feb. 2, 1981

Related U.S. Application Data

[62] Division of Ser. No. 945,969, Sep. 26, 1978, Pat. No. 4,274,491.

[51] Int. Cl.[3] ..... A62C 35/10

[52] U.S. Cl. ..... 169/46; 169/57

[58] Field of Search ..... 169/26, 42, 57, 9, 46; 102/65; 252/3, 2; 222/397

[56] References Cited

U.S. PATENT DOCUMENTS

| | | | |
|---|---|---|---|
| 2,800,187 | 7/1957 | Lehder | 169/42 X |
| 3,402,665 | 9/1968 | Tarpley, Jr. et al. | 102/65 |
| 3,827,502 | 8/1974 | Lockwood | 169/26 X |
| 4,060,489 | 11/1977 | Chiesa, Jr. | 252/3 |

FOREIGN PATENT DOCUMENTS

| | | | |
|---|---|---|---|
| 12532 | of 1911 | United Kingdom | 169/57 |

*Primary Examiner*—Stanley H. Tollberg

*Attorney, Agent, or Firm*—Seidel, Gonda, Goldhammer & Panitch

[57] ABSTRACT

A chamber is provided with a built-in material dispenser. A confined space such as a conduit associated with the chamber contains a pressurized material, such as fire suppressant, which is released when the chamber is subjected to one or more of the following: heat above a predetermined temperature, an impact force as occasioned by a collision, pressure above a predetermined limit, etc.

19 Claims, 7 Drawing Figures

FIG. 1
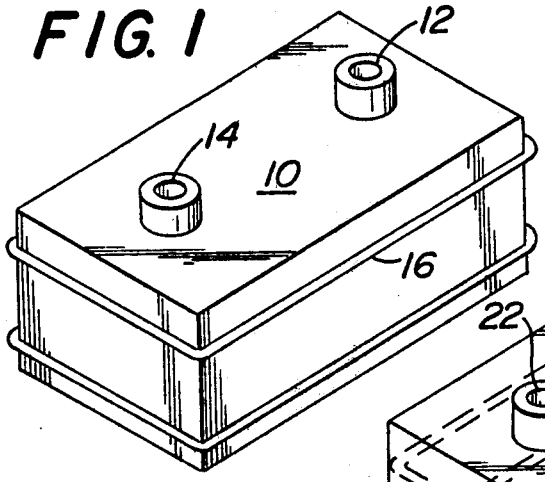
FIG. 2
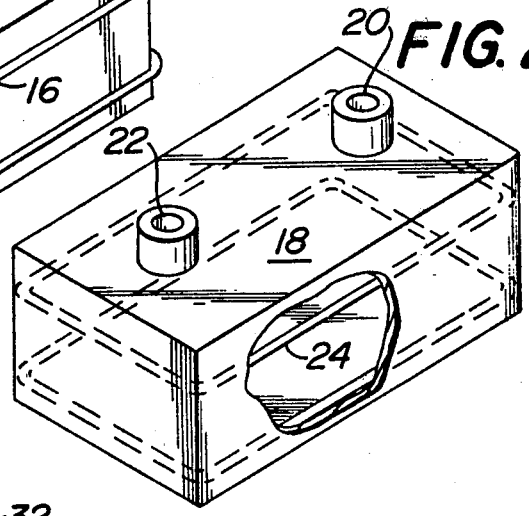
FIG. 5
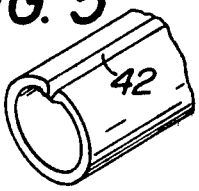
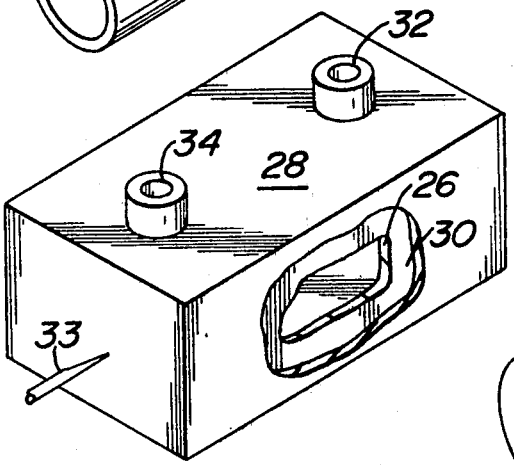
FIG. 3
FIG. 4
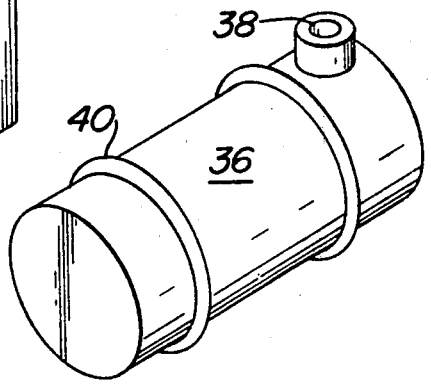
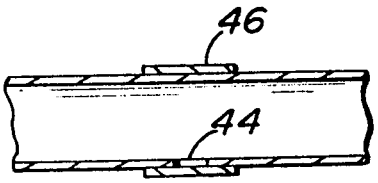
FIG. 6
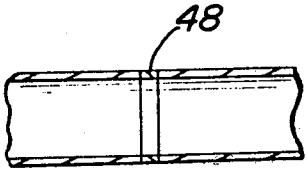
FIG. 7

APPARATUS FOR CONTINUOUS DISCHARGE OF MATERIAL AT LOCALIZED DAMAGE POINT

CROSS REFERENCE TO RELATED APPLICATION

This application is a divisional application of my copending Application Ser. No. 945,969, filed Sept. 26, 1978, issued as U.S. Pat. No. 4,274,491.

BACKGROUND OF THE INVENTION

The present invention relates to apparatus for the substantially continuous discharge of material from a confined space associated with a chamber at a localized damage point of the walls of means defining the confined space. The chamber may be of any type, size or shape, and may be, for example, a room in a building, a vehicle cabin, a fuel storage tank, a small portable dispenser containing materials designed for personal protection, such as tear gas dispensers, and the like.

The confined space may be defined by a meltable or breakable conduit or the walls of a double walled chamber or the like. The pressurized material may include any material which is desired to be dispensed which is capable of being pressurized. Suitable materials may include, for example, marker dyes, pyrotechnic material, repellent substances such as tear gas and fire suppressant materials.

An important basic feature of the present invention is that the pressurized material will be released at the point where the means defining the confined space containing the pressurized material is melted, pierced or otherwise ruptured. In case of collisions, for example, the point of piercing is likely to lead to the greatest damage and potential for fire or explosion, as where a vehicle having a fuel tank is involved. If the confined space is opened, the pressurized material will be dispensed at the point of opening where the pressurized material is likely to be needed the most.

As used herein, means defining a confined space is "breakable" when it is breakable, frangible, rupturable or pierceable by an internal or external force in excess of that expected to be encountered in the environment in which the invention is intended to be used. The term "readily breakable" is used herein to indicate that the degree of breakability is to be adjusted to the sensitivity desired for the discharge of the pressurized material in a particular application. The degree of breakability may be adjusted according to the sensitivity desired for the discharge of the pressurized material in a particular application.

As used herein, means defining a confined space is "meltable" when it is melted or softened by heat to the point where it is so weakened that the contents of the confined space may be discharged from the means defining the confined space.

Although the present invention is applicable to many broad and diverse areas, it will be described in more detail with particular reference to its use in fire suppression, where the pressurized material is a fire suppressant. As used herein, a "suppressant" is an agent which is capable of extinguishing, inhibiting or retarding the growth or development of combustion. Thus, a suppressent agent may be used to extinguish a fire, prevent reignition of the extinguished fire and may be used to prevent combustion of new fuel sources in the area of existing, potential or previously extinguished combustion.

The present invention includes means defining a chamber. In a confined space associated with the chamber, there is pressurized material, such as fire suppressant. The means defining the confined space is constructed in a manner so as to allow discharge of the material when subjected to heat above a predetermined temperature and/or impact force of a collision between said chamber and some other object and/or any other internal or external rupturing force.

SUMMARY OF THE INVENTION

The invention comprises a dispenser in combination with chamber means, the dispenser comprising means defining a confined space associated with the chamber and containing pressurized material, the means defining the confined space being constructed of a substance selected from the group consisting of breakable and meltable substances so as to allow discharge of the material when said substance is broken or melted.

It is an object of this invention to provide a dispenser comprising a pressurized material within a conduit or between double walls of a chamber which will continuously dispense substantially all of the pressurized material at a localized damage point of the conduit or wall, such as a rupture point caused by excessive heat, pressure or the like.

It is another object of the present invention to provide a fire extinguisher which is automatic and adapted for use as part of the design of the construction of a chamber.

It is another object of the present invention to provide a fire extinguisher which will automatically extinguish a fire in a variety of types of chambers including buildings, rooms, aircraft cabins, buses, automobiles, fuel delivery trucks, etc.

Other objects will appear hereinafter.

BRIEF DESCRIPTION OF THE DRAWINGS

For the purpose of illustration the invention, there is shown in the drawings a form which is presently preferred; it being understood, however, that this invention is not limited to the precise arrangements and instrumentalities shown.

FIG. 1 is a perspective view of a container incorporating the present invention.

FIG. 2 is a perspective view of another embodiment of a container incorporating the present invention.

FIG. 3 is a perspective view of another embodiment of a container incorporating the present invention.

FIG. 4 is a perspective view of another embodiment of a container incorporating the present invention.

FIG. 5 is a perspective view of one end portion of a conduit to be associated with a chamber according to the present invention.

FIG. 6 is a sectional view through a portion of another conduit to be associated with a chamber according to the present invention.

FIG. 7 is a sectional view through a portion of another conduit to be associated with a chamber according to the present invention.

DESCRIPTION OF THE PREFERRED EMBODIMENTS

Referring to the drawings in detail, wherein like numerals indicate like elements, there is shown in FIG. 1 a container 10 having an inlet 12 and an outlet 14. Attached to the outer surface of container 10 in any convenient manner such as by clamps, fasteners, adhesive, and the like, there is provided a conduit 16. Conduit 16 defines a confined space containing a pressurized material, such as fire suppressant.

Container 10 and the other containers illustrated in the drawings are merely for purposes of illustration. The containers represent any type of chamber having any size and shape. Means defining a confined space is illustrated as conduit 16 which is attached to the walls of the container. Again, this is merely for purposes of illustration. Means defining a confined space need not be attached directly to the walls of the chamber, but may be indirectly attached to a surface of the chamber by hanging fasteners, intermediate attachment to a supporting plate, or the like. Because of these varying types of direct andindirect attachment of means defining a confining space to a chamber, the term "associated with" will be used herein. Preferably, where means defining a confining space is breakable, it is directly adjacent to one or more walls of a chamber.

In FIG. 2, there is illustrated a container 18 having an inlet 20 and an outlet 22. On the inner surface of the container 18, there is attached a conduit 24 in any convenient manner as described above. Conduit 24 defines a confined space containing a pressurized material, such as fire suppressant.

In FIG. 3, there is illustrated a container 26 having an inlet 32 and an outlet 34. Container 26 is surrounded by a container 28. Due to the difference in the sizes of the containers 26 and 28, a confined space 30 containing a pressurized material is defined between the walls of container 26 and the walls of container 28. Spaced from container 28 and supported in any convenient manner, there is provided a pointed spike 33 adapted to pierce the wall of container 28 and permit discharge of the fire suppressant upon a collision between container 28 and spike 33.

Spike 33 is merely representative of one way of opening confined space 30. The walls of containers 26 and/or 28 may be broken by any other object capable of penetrating the containers. A chamber and associated means defining a confined space as illustrated in FIG. 3 may be very useful for fuel storage containers, such as gasoline or other fuel tanks for vehicles, or for fuel transportation vehicles.

In FIG. 4, there is illustrated a container 36 having a combination inlet and outlet 38. Conduits 40 circumscribe the container 38 and define a confined space containing a pressurized material, such as fire suppressant.

Each of the containers 10, 18, 26, and 28 defines a chamber which may contain fuel or other combustible material or may constitute a room in a structure such as a building, submarine, airplaine, automobile, truck, or the like. Whenever the chamber is subjected to heat above a predetermined temperature, pressure above a predetermined limit, or is subjected to a collision, or other force suitable to break, pierce or rupture the means defining the confined space, the people or contents of the chamber may be subjected to great danger. The predetermined temperature and pressure limits are determined by the type of material used to make the means defining the confined space. The limits are the melting point and breaking strength of the material. In any of these circumstances, the present invention automatically discharges the material under pressure from the confined space to the immediate area of the chamber since the confined space is associated with the chamber.

Exposure of the pressurized material in FIG. 3 is attained by the spike 33 piercing the wall of housing 28. Breakage of the conduits 16, 24, or 40 may be attained in any manner. Thus, for example, the conduit may be made entirely or partially from a breakable substance, such as glass, which will rupture on impact and permit discharge of the pressurized material.

The means defining a confined space containing the pressurized material may be any other type of breakable or meltable substance. Where it is desired to use a meltable substance to form the means defining the confined space for containing the pressurized material, any substance having a melting point within the design characteristics of the system is suitable. Where weight is not a problem, lead pipes may be used. Preferably, means defining the confined space should be breakable and/or meltable at least in several portions along its surfaces so that discharge of the pressurized material contained therein can occur at the point of damage caused by fire, puncture or the like. Alternate embodiments of means defining a confined space include, for example, means constructed in the manner shown in FIGS. 5, 6 and 7.

In FIG. 5, there is illustrated an end portion of a conduit having a longitudinally extending slot filled with solder or some other substance which will melt when subjected to heat above a predetermined temperature. When the solder 42 melts, the pressurized material discharges through the longitudinally extending slot in the conduit. The slot or other hole may be positioned to cause the material to be discharged at a certain portion of the chamber, such as in the center, along the walls, toward the ceiling or floor, or at particular objects placed within the chamber.

In FIG. 6, the conduit is provided with one or more holes 44 which are temporarily sealed by a cover strip 46. Cover strip 46 may be made from any one of a wide variety of materials which are readily consummable when subjected to heat above a predetermined temperature such as pressurized tape made from a polymeric plastic material.

In FIG. 7, there is illustrated two ends of a conduit soldered together at 48 to form a joint. The joint 48 is of such a nature that it will melt when subjected to a temperature above a predetermined limit and/or will rupture upon impact of an object to facilitate discharge of the pressurized material contained therein.

The pressurized material can be a gelled composition, a liquid, a gas, a solid or any combination of these materials.

Examples of pressurized materials particularly suited for use in the present invention are set forth in the following copending patent applications, the disclosures of which are hereby incorporated herein by reference: U.S. patent application Ser. No. 845,683, filed Oct. 26, 1977 in the name of William B. Tarpley, Jr. for Powder Dissemination Composition now U.S. Pat. No. 4,234,432, and U.S. patent application Ser. No. 926,786, filed July 21, 1978 in the names of William B. Tarpley, Jr., John R. Huzinec and Marion K. Freeman, for Persistent Fire Suppressant Composition, now U.S. Pat. No. 4,226,727.

Self-pressurized suppressants such as the liquefied gases bromotrifluoromethane, bromochlorodifluoromethane, dichlorodifluoromethane and thixotropically gelled suspensions of powders in liquefied gases and the like may be utilized. Compositions such as liquid dibromotetrafluoroethane, dichlorotetrafluoroethane or thixotropically gelled suspensions of suppressant powders can be externally pressurized with gases such as $N_2$ or $CO_2$ before sealing the confined space or conduit.

The conduits 16, 24 and 40 have a practical minimum diameter of about 1/16 inch with the preferred maximum diameter preferably exceeding a length to diameter ratio of 5. Aluminum is a desirable material for such conduits due to the fact that it is low in weight and non-corrosive.

Polymeric plastic and/or elastomeric tubing, such as polyphenylene sulfide, and copolymers of butadiene and acrylonitrile, known generally as Buna N, is also desirable for the foregoing reasons. The type of plastic tubing depends on its compatibility with the pressurized material. Preferably, these polymeric substances should have a low melting or softening point, on the order of about 300°-700° F. In general, polymeric plastics and elastomers do not have a well defined melting point at which they turn from crystalline solids to liquids. Rather, they have fairly broad temperatures at which they are transformed from semi-crystalline substances to amorphous, glassy substances.

Where weight is not a problem, the conduits may be made from other substances such as lead which is relatively easy to pierce and has a lower melting point than aluminum.

The conduits 16, 24 and 40 are preferably made of a substance which is easy to shape so as to conform to the contour of the chamber, and the conduits may be fixed directly to the walls defining the chamber or may be mechanically attached to a surface supported by the chamber to be protected.

The present invention will now be described in more detail with reference to the following specific, non-limiting examples.

EXAMPLE 1

Fire suppressant liquefied gases or liquids plus liquefied gases are chilled below their boiling points and loaded into tubing to allow 15 volume percent ullage. The tubing is then sealed by mechanical sealing, soldering, welding or adhesive bonding as appropriate. Table 1 illustrates various parameters for the respective suppressant and tubing materials and dimensions.

TABLE 1

| Fire Suppressant | | Tubing | | | | |
|---|---|---|---|---|---|---|
| Ingredients | Amount per 100 ft. Tubing (lbs.) | O.D. (in.) | Material | Melting Point (°F.) | Wall Thickness (in.) | Weight per 100 ft. Tubing (lbs.) |
| Bromotrifluoromethane | 2.34 | 0.25 | Aluminum | 1190 | 0.009 | 0.75 |
| Bromotrifluoromethane | 2.34 | 0.25 | Steel (lap soldered) | 421 | 0.009 | 2.58 |
| Bromotrifluoromethane | 1.63 | 0.25 | 50/50 tin lead solder | 421 | 0.028 | 7.54 |
| Bromotrifluoromethane (25% by weight) plus Dibromotetrafluoroethane (75% by weight) | 13.5 | 0.5 | Aluminum | 1190 | 0.018 | 3.0 |
| Bromotrifluoromethane (25% by weight) plus Dibromotetrafluoroethane (75% by weight) | 14.3 | 0.5 | Steel (lap soldered) | 421 | 0.011 | 5.3 |
| Bromotrifluoromethane (25% by weight) plus Dibromotetrafluoroethane (75% by weight) | 13.7 | 0.5 | Polyphenylene sulfide | — | 0.016 | 1.45 |
| Bromotrifluoromethane (25% by weight) plus Dibromotetrafluoroethane (75% by weight) | 10.0 | 0.5 | Buna N | — | 0.049 | 2.3 |

EXAMPLE 2

A fire suppressant composition is prepared comprising 69% by weight potassium bicarbonate powder, 30% by weight bromotrifluoromethane and 1% pyrogenic silica. The composition, while still cold, is loaded into tubing as indicated in Table 2 and sealed by mechanical tubing fittings. The tubes are filled to permit 15% ullage volume.

TABLE 2

| Tube Material | O.D. (in.) | Wall Thickness (in.) | Weight per 100 ft. Tubing (lbs.) | Weight of fire suppressant per 100 ft. Tubing (lbs.) |
|---|---|---|---|---|
| Aluminum | 0.25 | 0.009 | 0.74 | 2.96 |
| Steel (lap soldered) | 0.25 | 0.009 | 2.15 | 2.96 |
| 50/50 tin lead solder | 0.25 | 0.028 | 7.54 | 2.07 |
| Aluminum | 0.5 | 0.018 | 3 | 11.84 |
| Steel (lap soldered) | 0.5 | 0.011 | 5.3 | 12.56 |
| 50/50 tin lead solder | 0.5 | 0.058 | 31 | 8.11 |
| Aluminum | 0.75 | 0.027 | 7.2 | 26.6 |
| Steel (lap soldered) | 0.75 | 0.0149 | 12.27 | 28.5 |
| 50/50 tin lead solder | 0.75 | 0.083 | 66.88 | 18.9 |

The melting point of aluminum is 1190° F., that of the solder is 421° F. If mechanical damage does not cause the discharge of the material contained in the tube, softening and melting of the tube in a fire will cause such discharge.

EXAMPLE 3

A persistent fire suppressant composition as taught in copending U.S. patent application Ser. No. 926,786, referred to hereinbefore, comprises 21% by weight chopped polyurethane foam, 24% by weight dibromotetrafluoroethane, 53.5% by weight bromotrifluoromethane, and 0.5% by weight silica. The composition is mixed and loaded into tubing as set forth in Table 3. The tubing is then welded shut.

TABLE 3

| Tube Material | O.D. (in.) | Wall Thickness (in.) | Weight per 100 ft. Tubing (lbs.) | Weight of Suppressant (lbs.) |
|---|---|---|---|---|
| Aluminum | 0.5 | 0.018 | 3 | 9.34 |
| Steel (lap soldered) | 0.5 | 0.011 | 5.3 | 9.92 |
| Aluminum | 0.75 | 0.027 | 7.2 | 21 |
| Steel (lap soldered) | 0.75 | 0.0149 | 12.3 | 22.5 |

The present invention may be embodied in other specific forms without departing from the spirit or essential attributes thereof and, accordingly, reference should be made to the appended claims, rather than to the foregoing specification, as indicating the scope of the invention.

I claim:

1. A dispenser in combination with chamber means, said dispenser comprising means defining a confined space associated with said chamber means and containing a pressurized thixotropically gelled material, comprising a thixotropically gelled suspension of fire suppressant powder in liquefied gas, said means defining said confined space being constructed of a substance selected from the group consisting of readily breakable and meltable substances so as to allow discharge of said material when said substance is broken or melted.

2. Apparatus in accordance with claim 1 wherein said means defining a confined space is at least one conduit attached to at least one wall of said chamber means.

3. Apparatus in accordance with claim 2 wherein said conduit is on the outer surface of said wall.

4. Apparatus in accordance with claim 2 wherein said conduit is on the inner surface of said wall.

5. Apparatus in accordance with claim 1 wherein said means defining a confined space includes walls spaced radially outwardly from said chamber means and said space being between said chamber means and said walls.

6. Apparatus in accordance with claim 1 wherein said means defining a confined space includes a conduit having a passage sealed by a melted substance.

7. Apparatus in accordance with claim 1 wherein said means defining a confined space includes a conduit having at least one hole temporarily sealed by a material adapted to be consumed by fire to expose said hole and through which said fire suppresant may be discharged.

8. Apparatus comprising wall means defining a chamber to be protected from fire, conduit means attached to said wall means and defining a sealed confined space, and a pressurized thixotropically gelled fire suppressant in said space, said conduit means including means to facilitate discharge of said fire suppressant under conditions where such chamber is in danger of being exposed to fire.

9. Apparatus in accordance with claim 1 wherein said means defining a confined space is a conduit having a passage sealed by a readily breakable substance.

10. Apparatus in accordance with claim 1 wherein said means defining a confined space is meltable.

11. Apparatus in accordance with claim 1 or claim 10 wherein said means defining a confined space is made of lead.

12. Apparatus in accordance with claim 1 wherein said means defining a confined space is readily breakable.

13. Apparatus in accordance with claim 2 wherein said conduit is metallic.

14. A process of dispensing material from a dispenser, said dispenser comprising means defining a confined space associated with a chamber means, comprising filling said means defining a confined space with a pressurized fire suppressant material comprising a thixotropically gelled suspension of fire suppressant powder in liquefied gas, and making said means defining a confined space of a substance selected from the group consisting of readily breakable and meltable substances so as to allow discharge of said fire suppressant material when said substance is broken or melted.

15. A process in accordance with claim 14 wherein said means defining a confined space is at least one conduit and including attaching said conduit to at least one wall of said chamber means.

16. A process according to claim 14 wherein said means defining a confined space includes a conduit having a passage sealed by a meltable substance.

17. A process according to claim 14 wherein said means defining a confined space is made of a readily breakable substance.

18. A process according to claim 14 wherein said means defining a confined space is made of a meltable substance.

19. Apparatus in accordance with claim 8 wherein said means to facilitate discharge of said fire suppressant is a member adapted to pierce said conduit means.

* * * * *

UNITED STATES PATENT AND TRADEMARK OFFICE

CERTIFICATE OF CORRECTION

PATENT NO. : 4,367,799

DATED : January 11, 1983

INVENTOR(S) : William B.Tarpley, Jr.

It is certified that error appears in the above-identified patent and that said Letters Patent is hereby corrected as shown below:

On the title page under (*) Notice:

"June 23, 1982" should read -- June 23, 1998 --.

Signed and Sealed this

*Twenty-first* Day of *June 1983*

[SEAL]

*Attest:*

DONALD J. QUIGG

*Attesting Officer*

*Acting Commissioner of Patents and Trademarks*